US010288088B2

(12) United States Patent
Gabbin et al.

(10) Patent No.: US 10,288,088 B2
(45) Date of Patent: May 14, 2019

(54) IMPELLER FOR AN ELECTRIC FAN

(71) Applicant: JOHNSON ELECTRIC INTERNATIONAL AG, Murten (CH)

(72) Inventors: Giuliano Gabbin, Asti (IT); Ermanno Procopio, Asti (IT)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 252 days.

(21) Appl. No.: 14/593,453

(22) Filed: Jan. 9, 2015

(65) Prior Publication Data

US 2015/0198177 A1 Jul. 16, 2015

(30) Foreign Application Priority Data

Jan. 10, 2014 (IT) ..... TO2014U0004

(51) Int. Cl.
*F04D 29/66* (2006.01)
*F04D 19/00* (2006.01)
*F04D 29/32* (2006.01)

(52) U.S. Cl.
CPC ..... *F04D 29/666* (2013.01); *F04D 19/002* (2013.01); *F04D 29/326* (2013.01); *F04D 29/329* (2013.01)

(58) Field of Classification Search
CPC .... F04D 29/666; F04D 29/668; F04D 29/665; F04D 29/661; F04D 29/662; F04D 29/663; F04D 29/329; F04D 29/328; F04D 29/326; F04D 19/002; F05B 2260/96
USPC ..... 416/182, 500
See application file for complete search history.

(56) References Cited

U.S. PATENT DOCUMENTS

D206,695 S * 1/1967 Dickinson ..... 416/245 A
3,385,516 A * 5/1968 Omohundro ..... F04D 25/082 416/186 R
3,449,605 A * 6/1969 Wilson ..... B01D 46/0021 310/58
3,993,415 A * 11/1976 Hauser ..... F01P 7/042 123/41.49
4,358,245 A * 11/1982 Gray ..... F01P 7/06 123/41.49
4,583,911 A * 4/1986 Braun ..... F04D 29/681 415/116

(Continued)

FOREIGN PATENT DOCUMENTS

JP H 09317686 12/1997

*Primary Examiner* — Ninh H. Nguyen
*Assistant Examiner* — Wayne A Lambert
(74) *Attorney, Agent, or Firm* — Muncy, Geissler, Olds & Lowe, P.C.

(57) ABSTRACT

An impeller for an electric fan, has a central hub for connection to the rotor of an electric motor, and from which a plurality of blades extends. The hub is bowl-shaped, with an end wall which is connected to an annular lateral wall, and its end wall has a plurality of slots, spaced apart circumferentially, which are inclined in the same direction with respect to the radial direction. The inner surface of the end wall of the hub has a plurality of ribs protruding from this surface, between the slots, these ribs also being inclined in the same direction with respect to the radial direction and being adapted to serve as inner fan blades. These ribs have at least one substantially transverse cut-out or interruption in a predetermined position.

14 Claims, 2 Drawing Sheets

(56) References Cited

U.S. PATENT DOCUMENTS

| | | | | | |
|---|---|---|---|---|---|
| 4,838,760 | A * | 6/1989 | Brackett | F04D 25/082 | 416/183 |
| 5,193,981 | A * | 3/1993 | Scheidel | F04D 29/661 | 416/169 A |
| 5,244,347 | A * | 9/1993 | Gallivan | F04D 29/325 | 415/208.2 |
| 5,577,888 | A * | 11/1996 | Capdevila | F04D 29/325 | 165/122 |
| 5,871,335 | A * | 2/1999 | Bartlett | F04D 29/263 | 403/349 |
| 6,830,434 | B2 * | 12/2004 | Kondo | F04D 29/329 | 416/169 A |
| 7,585,159 | B2 * | 9/2009 | Caplan | F01D 5/34 | 416/169 A |
| 7,598,634 | B2 * | 10/2009 | Izumi | F04D 25/0613 | 310/58 |
| 8,091,177 | B2 * | 1/2012 | Cote | F04D 29/329 | 16/203 |
| 9,206,816 | B2 * | 12/2015 | Olmo | F04D 29/326 | |
| 2010/0068060 | A1 * | 3/2010 | Ota | F04D 29/325 | 416/179 |
| 2010/0215505 | A1 * | 8/2010 | Takeshita | F04D 25/0613 | 416/223 R |
| 2012/0163991 | A1 * | 6/2012 | Niegorski | F04D 29/663 | 416/93 R |
| 2012/0189451 | A1 * | 7/2012 | Innocenti | B60K 11/02 | 416/189 |

* cited by examiner

IMPELLER FOR AN ELECTRIC FAN

CROSS REFERENCE TO RELATED APPLICATIONS

This non-provisional patent application claims priority under 35 U.S.C. § 119(a) from Utility Model Application No. TO 2014 U 000004, filed in Italy on Jan. 10, 2014, the entire contents of which are hereby incorporated by reference.

FIELD OF THE INVENTION

This invention relates to a fan for cooling a heat exchanger of a vehicle and in particular, to an impeller of the fan.

BACKGROUND OF THE INVENTION

More specifically, the invention proposes an impeller of the type comprising: a central hub which is intended to be connected to the rotor of an electric motor, and from which a plurality of blades extends, the hub having a substantially bowl-like shape, with an end wall connected to an annular lateral wall which is at least approximately cylindrical, the end wall having a plurality of slots, spaced apart circumferentially, which are inclined in the same direction with respect to the radial direction, the inner surface of said end wall having a plurality of ribs protruding from this surface, between said slots, these ribs also being inclined in said same direction with respect to the radial direction and being adapted to serve as inner fan blades.

In operation, vibrations generated by the electric motor driving the impeller are transmitted to the impeller, and may cause the generation of acoustic noise at frequencies that are annoying to the human ear, particularly at low speeds.

SUMMARY OF THE INVENTION

Hence there is a desire for a modified impeller of the type specified above, which enables the aforementioned drawback to be overcome, and which can be provided in a simple and economical manner.

This is achieved in the present invention by providing an impeller in which the aforesaid ribs of the end wall of the hub have at least one substantially transverse cut-out or interruption in a predetermined position.

Accordingly, in one aspect thereof, the present invention provides an impeller for an electric fan, comprising: a central hub arranged to be connected to the rotor of an electric motor, and having a substantially bowl-like shape, with an end wall which is connected to an annular lateral wall which is at least approximately cylindrical; a plurality of blades extending from the hub; a plurality of slots formed in the end wall of the hub, the slots being spaced apart circumferentially, and are inclined in the same direction with respect to the radial direction; and a plurality of ribs protruding from an inner surface of the end wall of the hub between the slots, the ribs being inclined in the same direction with respect to the radial direction and being adapted to serve as inner fan blades, wherein each of the ribs have at least one substantially transverse cut-out or interruption in a predetermined position.

Preferably, each of the ribs has a substantially transverse cut-out or interruption at each of its ends.

Each of the ribs of the hub may advantageously have at least one further cut-out or interruption in one of its intermediate portions.

Preferably, the one or more cut-outs or interruptions of the ribs are made on one or more circumferences substantially coaxial with the hub.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
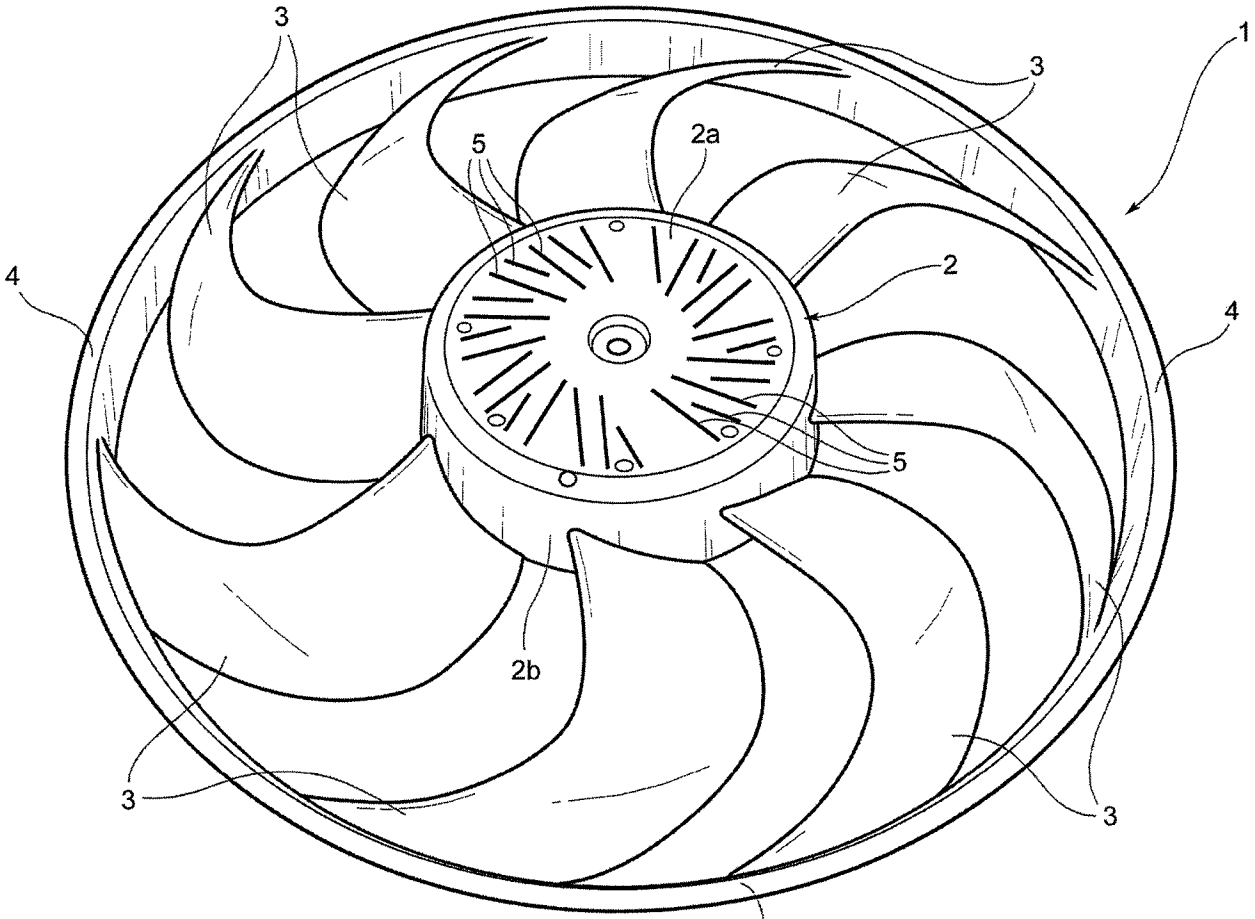
FIG. 1 is a front perspective view of an impeller according to the preferred embodiment of the present invention.

In the drawings, reference numeral 1 indicates the whole of an impeller according to the invention for an electric fan, particularly for a heat exchanger (radiator) of a motor vehicle.

The impeller 1 comprises, in a known way, a central hub 2 which is intended to be connected to the rotor of an electric motor (not shown). A plurality of curved blades 3 extends from the hub 2, the radially outer ends of the blades being connected to a peripheral ring 4. The hub 2 has a substantially bowl-like shape, with an end wall 2*a* which is connected to an annular lateral wall 2*b* which is at least approximately cylindrical. The end wall 2*a* of the hub 2 has a plurality of slots 5, spaced apart circumferentially. The slots 5 are inclined in the same direction with respect to the radial direction. These slots 5 are made in a radially outermost annular band or circular crown 2*c* of the end wall 2*a* of the hub.

The radially innermost portion 2*d* of the end wall of the hub 2 has no slots, and in the embodiment shown by way of example it has a central opening 2*e* for the passage of a member for fastening the hub to the rotor of the electric driving motor. The inner surface of the end wall 2*a* of the hub 2 in the radially outermost annular band 2*c* has a plurality of ribs 6. These ribs 6 protrude from the inner surface of the end wall 2*a* of the hub 2, between the slots 5, and are also inclined in the aforesaid same direction with respect to the radial direction.

In a known way, the ribs 6 serve, in operation, as inner fan blades, and preferably also extend on to the inner surface of the annular lateral wall 2*b* of the hub 2. According to the present invention, each of the portions of the ribs 6 extending from the end wall 2*a* of the hub has at least one essentially transverse cut-out or interruption, in a predetermined position.

Figure 2:
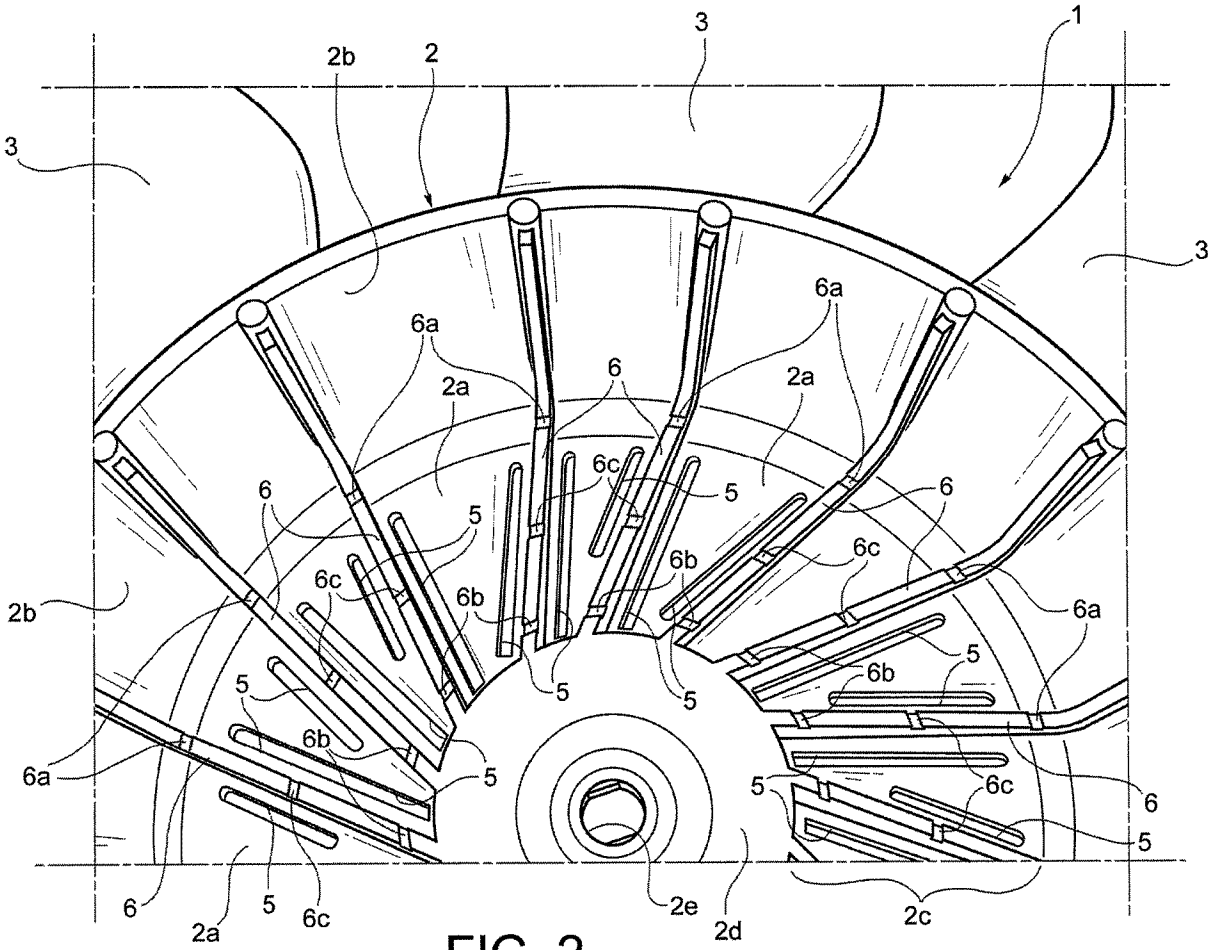
FIG. 2 is an enlarged, partial, rear perspective view of the impeller of FIG. 1.

In the embodiment illustrated in FIG. 2, in the annular band 2*c* of the inner surface of the hub 2, each rib 6 has a pair of cut-outs or interruptions 6*a* and 6*b* at its ends. Each of these ribs 6 has a further cut-out or interruption 6*c*, in one of its intermediate portions. Conveniently, but not necessarily, the one or more cut-outs or interruptions 6*a*, 6*b* or 6*c* of the ribs 6 are made on one or more circumferences coaxial with the hub 2 of the impeller 1.

By suitably positioning the cut-outs described above, it is possible to reduce appreciably the vibrations of the impeller caused by vibrations of the electric motor coupled thereto, and correspondingly to reduce the generated acoustic noise, at certain frequencies at least.

In the description and claims of the present application, each of the verbs "comprise", "include", "contain" and "have", and variations thereof, are used in an inclusive sense, to specify the presence of the stated item or feature but do not preclude the presence of additional items or features.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of example only, and various other modifications will be apparent to persons skilled in the field without departing from the scope of the invention as defined by the appended claims.

The invention claimed is:

1. An impeller for an electric fan, comprising:

a hub arranged to be connected to a rotor of an electric motor, and having a substantially bowl-like shape, with an end wall which is connected to an annular lateral wall which is approximately cylindrical;

a plurality of blades extending from the hub;

a plurality of slots formed in the end wall of the hub, the plurality of slots being spaced apart circumferentially, and extending in directions angled with respect to radial directions of the hub; and a plurality of ribs protruding from an inner surface of said end wall of the hub adjacent to the plurality of slots, the plurality of ribs extending in directions angled with respect to radial directions of the hub and being adapted to serve as inner fan blades, wherein each of the plurality of ribs has at least one substantially transverse interruption in a predetermined position to cut a corresponding rib into at least two discontiguous segments, and thus reducing vibration of the impeller, and wherein the at least one substantially transverse interruption is a rectangular notch when viewed from the axial direction of the hub.

2. The impeller according to claim 1, wherein each of the plurality of ribs has a substantially transverse interruption at each of its ends.

3. The impeller according to claim 1, wherein each of the plurality of ribs of the hub has a substantially transverse interruption in one of its intermediate portions.

4. The impeller according to claim 1, wherein the substantially transverse interruptions of the plurality of ribs of the hub are located on one or more circumferences substantially coaxial with the hub.

5. The impeller according to claim 1, wherein the substantially transverse interruptions formed in the plurality of ribs are discontinuous in the circumferential direction of the hub.

6. The impeller according to claim 1, wherein each of the plurality of ribs has a substantially transverse interruption at an end closer to a center of the end wall.

7. An impeller for an electric fan, comprising:

a hub arranged to be connected to a rotor of an electric motor, with an end wall which is connected to an annular lateral wall which is approximately cylindrical;

a plurality of blades extending from the hub; and a plurality of ribs protruding from an inner surface of said end wall of the hub, wherein each of the plurality of ribs has at least one substantially transverse interruption in a predetermined position to cut a corresponding rib into at least two discontiguous segments, and thus reducing vibration of the impeller, and wherein the at least one substantially transverse interruption is a rectangular notch when viewed from the axial direction of the hub.

8. The impeller according to claim 7, wherein each of the plurality of ribs extends in a direction angled with respect to a corresponding radial direction of the hub.

9. An impeller for an electric fan, comprising:

a hub arranged to be connected to a rotor of an electric motor, with an end wall which is connected to an annular lateral wall which is approximately cylindrical;

a plurality of blades extending from the hub; and a plurality of ribs protruding from an inner surface of said end wall of the hub, wherein each of the plurality of ribs has at least one substantially transverse cut out or interruption in a predetermined position to reduce vibration of the impeller, each of the plurality of ribs has two portions respectively located at two opposite sides of the at least one substantially transverse cut out or interruption, and the two portions have substantially same heights in an axial direction of the hub, and wherein the at least one substantially transverse cut out or interruption is a rectangular notch when viewed from the axial direction of the hub.

10. The impeller according to claim 9, wherein each of the plurality of ribs has a substantially transverse cut out or interruption at each of its ends.

11. The impeller according to claim 9, wherein each of the plurality of ribs of the hub has a substantially transverse cut out or interruption in one of its intermediate portions.

12. The impeller according to claim 9, wherein the substantially transverse cut outs or interruptions of the plurality of ribs of the hub are located on one or more circumferences substantially coaxial with the hub.

13. The impeller according to claim 9, wherein the substantially transverse cut outs or interruptions formed in the plurality of ribs are discontinuous in the circumferential direction of the hub.

14. The impeller according to claim 9, wherein each of the plurality of ribs has a substantially transverse cut out or interruption at an end closer to a center of the end wall.

* * * * *